US011554570B2

(12) United States Patent
Boegli et al.

(10) Patent No.: US 11,554,570 B2
(45) Date of Patent: Jan. 17, 2023

(54) METHOD AND DEVICE FOR EMBOSSING PLANAR MATERIAL

(71) Applicant: BOEGLI-GRAVURES SA, Marin-Epagnier (CH)

(72) Inventors: Charles Boegli, Marin-Epagnier (CH); Werner Steffen, Stans (CH)

(73) Assignee: BOEGLI-GRAVURES SA

( * ) Notice: Subject to any disclaimer, the term of this patent is extended or adjusted under 35 U.S.C. 154(b) by 831 days.

(21) Appl. No.: 16/305,467

(22) PCT Filed: May 4, 2017

(86) PCT No.: PCT/IB2017/052585
§ 371 (c)(1),
(2) Date: Nov. 29, 2018

(87) PCT Pub. No.: WO2017/208092
PCT Pub. Date: Dec. 7, 2017

(65) Prior Publication Data

US 2020/0324505 A1 Oct. 15, 2020

(30) Foreign Application Priority Data

May 31, 2016 (EP) ..... 16172096

(51) Int. Cl.
*B31F 1/07* (2006.01)
*B31B 50/88* (2017.01)
(Continued)

(52) U.S. Cl.
CPC ..... *B31F 1/07* (2013.01); *B31B 50/88* (2017.08); *B44B 5/0047* (2013.01); *B44B 5/026* (2013.01);
(Continued)

(58) Field of Classification Search
CPC ..... B31F 1/07; B31F 2201/0738; B31F 2201/0733; B31F 2201/0743; B44B 5/026;
(Continued)

(56) References Cited

U.S. PATENT DOCUMENTS 4,033,059 A 7/1977 Hutton et al.
4,323,068 A * 4/1982 Aziz ..... A61F 13/51121 604/370
(Continued)

FOREIGN PATENT DOCUMENTS

AU 772613 5/2004
CA 2382597 11/2000
(Continued)

OTHER PUBLICATIONS

Official Action for European Patent Application No. 17728652.3, dated Mar. 16, 2020, 7 pages.
(Continued)

*Primary Examiner* — David H Banh
(74) *Attorney, Agent, or Firm* — Sheridan Ross P.C.

(57) ABSTRACT

A method for embossing a first grating in a planar material, by means of an embossing body and a counter embossing body, having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses. The method comprises on the embossing body providing a first plurality of obtuse pyramids intended to emboss the recesses of the first grating by exerting pressure on a first side of the planar material, the first plurality of obtuse pyramids forming first intermitted lines (row1, row2) cor-
(Continued)

responding to the intended recesses, and the pyramids in each subset corresponding to one of the first intermitted lines, being separated from each other by a determined distance that creates a gap in the line in such a manner that each gap from a line of pyramids may be connected to a corresponding gap from an adjacent line of pyramids by an imaginary line perpendicular to both of the adjacent lines; and roughening portions of the hard surface of the embossing body, the portions being located between adjacent lines of pyramids and intersecting at least one of the imaginary lines that connect one gap from one line to the corresponding gap from the adjacent line. On the counter embossing body, the method comprises providing a second plurality of obtuse pyramids intended to emboss the ridges of the first grating by exerting pressure on a second side of the planar material opposite to the first side, during embossing the obtuse summits of the pyramid pressing the planar material against a roughened portion of the hard surface of the embossing body, thereby satirizing the top surfaces of the ridges on the first side.

25 Claims, 10 Drawing Sheets

(51) Int. Cl.
*B44B 5/00* (2006.01)
*B44B 5/02* (2006.01)

(52) U.S. Cl.
CPC . *B31B 2241/003* (2013.01); *B31F 2201/0733* (2013.01); *B31F 2201/0738* (2013.01); *B31F 2201/0743* (2013.01)

(58) Field of Classification Search
CPC .. B44B 5/0047; B31B 50/88; B31B 2241/003
See application file for complete search history.

(56) References Cited

U.S. PATENT DOCUMENTS

| | | | | |
|---|---|---|---|---|
| 5,007,271 | A | 4/1991 | Boegli | |
| 5,598,774 | A | 2/1997 | Boegli | |
| 6,176,819 | B1 | 1/2001 | Boegli et al. | |
| 6,296,281 | B1 | 10/2001 | Stone | |
| 6,458,477 | B1 | 10/2002 | Hsu | |
| 6,665,998 | B1 | 12/2003 | Boegli | |
| 6,715,411 | B1 * | 4/2004 | Boegli | B31F 1/07 101/28 |
| 7,036,347 | B2 | 5/2006 | Boegli | |
| 7,147,453 | B2 | 12/2006 | Boegli | |
| 7,229,681 | B2 | 6/2007 | Boegli | |
| 8,038,922 | B2 | 10/2011 | Boegli | |
| 8,430,663 | B2 | 4/2013 | Boegli | |
| 8,495,900 | B2 | 7/2013 | Boegli | |
| 8,932,044 | B2 | 1/2015 | Boegli | |
| 9,140,834 | B2 | 9/2015 | Boegli | |
| 9,156,107 | B2 | 10/2015 | Boegli et al. | |
| 9,180,643 | B2 | 11/2015 | Boegli | |
| 9,481,141 | B2 | 11/2016 | Boegli | |
| 9,505,167 | B2 | 11/2016 | Boegli | |
| 9,579,924 | B2 | 2/2017 | Boegli | |
| 9,636,885 | B2 | 5/2017 | Boegli et al. | |
| 9,809,927 | B2 | 11/2017 | Boegli | |
| 9,939,725 | B2 | 4/2018 | Boegli et al. | |
| 9,993,895 | B2 | 6/2018 | Boegli et al. | |
| 10,083,253 | B2 | 9/2018 | Boegli et al. | |
| 10,183,318 | B2 | 1/2019 | Boegli et al. | |
| 2004/0151796 | A1 | 8/2004 | Boegli | |
| 2005/0279147 | A1 | 12/2005 | Boegli | |
| 2006/0188664 | A1 * | 8/2006 | Ando | C09D 183/04 428/1.1 |
| 2008/0116610 | A1 * | 5/2008 | Boegli | B31F 1/07 264/284 |
| 2009/0137977 | A1 * | 5/2009 | Fukae | A61F 13/512 604/378 |
| 2010/0061619 | A1 | 3/2010 | Boegli | |
| 2012/0018993 | A1 | 1/2012 | Boegli et al. | |
| 2012/0292821 | A1 | 11/2012 | Boegli | |
| 2013/0036928 | A1 * | 2/2013 | Rogers | B41F 16/00 101/483 |
| 2013/0273322 | A1 * | 10/2013 | Boegli | B29C 59/046 428/156 |
| 2014/0059977 | A1 | 3/2014 | Boegli | |
| 2015/0059599 | A1 * | 3/2015 | Boegli | B65B 19/228 101/23 |
| 2016/0075077 | A1 | 3/2016 | Boegli et al. | |
| 2017/0066079 | A1 | 3/2017 | Reisse et al. | |
| 2017/0282635 | A1 | 10/2017 | Boegli et al. | |
| 2018/0220698 | A1 | 8/2018 | Boegli et al. | |
| 2018/0370175 | A1 | 12/2018 | Boegli et al. | |

FOREIGN PATENT DOCUMENTS

| | | |
|---|---|---|
| CA | 2367423 | 5/2008 |
| DE | 202017105458 | 10/2017 |
| EP | 0146151 | 6/1985 |
| EP | 1521862 | 6/2007 |
| EP | 2572820 | 3/2013 |
| EP | 2653301 | 10/2013 |
| EP | 2842730 | 3/2015 |
| EP | 3300612 | 4/2018 |
| EP | 3415306 | 12/2018 |
| GB | 2479775 | 10/2011 |
| WO | WO 02/30661 | 4/2002 |
| WO | WO 2007/012215 | 2/2007 |
| WO | WO 2013/041430 | 3/2013 |
| WO | WO 2013/156256 | 10/2013 |
| WO | WO 2015/028939 | 3/2015 |
| WO | WO 2017/208092 | 12/2017 |

OTHER PUBLICATIONS

International Search Report and Written Opinion prepared by the European Patent Office dated Jul. 17, 2017, for International Application No. PCT/IB2017/052585.

* cited by examiner

METHOD AND DEVICE FOR EMBOSSING PLANAR MATERIAL

CROSS REFERENCE TO RELATED APPLICATIONS

This application is a national stage application under 35 U.S.C. 371 and claims the benefit of PCT Application No. PCT/IB2017/052585 having an international filing date of 4 May 2017, which designated the United States, which PCT application claimed the benefit of European Patent Application No. 16172096.6 filed 31 May 2016, the disclosure of each of which are incorporated herein by reference.

TECHNICAL FIELD

The invention relates to the technical field of fine embossing in metal coated planar material, more particularly to the embossing of a logo as a transitory image against a background, using at least two embossing rollers.

The invention is more particularly adapted for embossing packaging films for the tobacco industry or for the foodstuff industry, for example so-called inner liners which are wrapped about a number of cigarettes, or packaging material for chocolate, butter or similar foodstuff, electronic components, jewelry of watches.

BACKGROUND

It is known to produce security marks or esthetical improvements of metal coated embossed film in an online production chain using techniques described for example in the publication WO02/30661 to the present inventor. The production method described therein produces a so-called shadow effect that has a considerable contrast ratio. In order to produce this effect, a roller embossing process is used in which imaging pyramids on the embossing rollers are reduced in size or modified in such a way that light arriving under determined angles on the embossed films is reflected or reflected away.

It is known from developments of the intaglio technique in the printing industry that the use of picture elements in groups of parallel lines—image forming pattern elements or latent image structures—may improve the security against copying. Reference is made to publication EP 0 146 151 to De la Rue Giori SA. The relief-like groups of lines allow to make a so-called optical tilting effect, a change of picture at the same location depending on an angle of viewing, or as it is called in relevant literature using the term transitory effects—transitory image. The contrast can be durably improved by coating the recesses of the intaglio template with ink, as it is being done for example in the field of bank notes. The intaglio recesses are the underlying reason for the fact that the tilting effect is lost when copying, and this provides a real improvement of security.

U.S. Publication Pat. No. 4,033,059 describes a more ancient printing variant in which the intaglio technique is used to obtain transitory images on a paper web. A paper web as described in this publication has a longitudinal centerline and a transverse centerline, and comprises a plurality of first regions and a plurality of second regions. The first regions form boundaries separating the second regions, the first regions being substantially in a plane of the paper web. The second regions comprise a plurality of raised out-of-said-plane rib-like elements, the rib-like elements of each second region being disposed parallel to a major rib axis and perpendicular to a minor rib axis. All or most of each first regions have both major rib axis and minor rib axis components. The first and second regions undergo geometric deformation when the web material is subjected to an applied elongation along at least one axis. This approach, which remains interesting in a theoretical consideration, fails in reality because the simultaneous mastering of the contrast ratios in two or more transitory pictures at the same location is very difficult to achieve. When using soft materials, it is possible to obtain a line density of 100 to 1000 lines per inch, and this provides relatively good contrasts in an individual picture.

US publication U.S. Pat. No. 6,296,281 B1 provides a desirable improvement of the security print when embossing groups of lines, as compared to U.S. Pat. No. 4,033,059. The groups of lines are made either by the process of intaglio printing or so-called blind embossing, and are colored with black or colored ink. The use of interrupted line structures in this publication allows to address the disadvantage of U.S. Pat. No. 4,033,059 by improving the varying contrast ratios between two latent pictures.

An example of embossed groups of lines made by the process of blind embossing, wherein lines are colored with ink, for example black ink and the background is a white colored surface of the embossed material is shown in FIG. 1, where a logo made from a combination of the letters "b" and "g" is represented using lines which are perpendicular to line representing the surroundings of the logo. FIG. 2 represents a further example in which the digits 6 and 0 are represented.

An important industrial use of embossing techniques is the online roller embossing of metal coated inner liner planar material, e.g., in the food industry or for tobacco products.

Planar material to be embossed may generally be either inner liners—cigarette pack inner liners—or foils, which may generally be called thin foils. Foils typically may have a thickness from about 5 μm to about 400 μm. Such foils may in some cases be used as inner liners, which are used, e.g., in cigarette packaging—cigarette pack inner liners—and may for example be made out of metal coated paper, e.g., vapor coated base paper or aluminum layered paper. These foils and inner liners are thus thin and relatively un-elastic, i.e., very hard. They are often particularly adapted for food safe packaging because they are to a high degree impermeable to water vapor.

Foils and inner liners can be directly and quickly embossed using rollers with hard steel surfaces.

Following types of inner liners may for example be relevant:

- thin metal foils, e.g., aluminum foils;
- laminates made out of paper and/or plastic layers and metal foils, and metallized paper or metallized plastic films or laminates or similar substances;
- any film, in particular plastic film;
- any metal foil or plastic film laminated with paper with a grammage of about 20 to 90 g/m2;
- metallized paper or metallized plastic film with a grammage of 40 to 90 g/m2 or metallized plastic film with a thickness of 6 μm to 90 μm;
- the surface to be embossed of said materials may be uncoated or coated with lacquer or a slip coating;
- the surface of said materials may be of matt or bright type and may be colored; and
- metal foil.

It is further known to have simple uses of embossing by using lines in the range of millimeters to obtain mechanical creasing or softening of paper, whereby this does not produce any optical effects such as reflexion of diffraction. Reference is made for example to US publication U.S. Pat. No. 6,458,447 B1.

Problem Solved by the Invention

The solution known from prior art reference WO02/30661 for position dependent picture representations is to be improved, with the aim of preserving the contrast ratios and the pronounced tilting effect, and achieving a better security against copying for at least two latently present transitory pictures. The invention further aims at providing a solution for a device and a method that may be used in production scenarios where planar material, e.g., metal coated planar material, is embossed by means of roller embossing with typical industrial speeds.

The metal coated planar material to be embossed has for example a thickness between 25 μm and 80 μm.

Since the embossed planar material is to be used for food packaging, e.g., tobacco, butter, chocolate, it should not be treated with ink or any other similar substances. The invention should avoid the use of ink while still allowing to achieve good contrasts, even when using normal types of paper and in mass production scenarios. At the same time the invention should be usable for production speeds in rotation embossing processes of for example 300 meters/minute, which may correspond to about 1000 packages per minute. It will easily be understood that no ink would be able to try under such production speeds.

SUMMARY OF THE INVENTION

In a first aspect the invention provides a method for embossing a first grating in a planar material, by means of an embossing body and a counter embossing body, having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses. The method comprises on the embossing body providing a first plurality of obtuse pyramids with respective rhomboid-shaped bases which are on the hard surface of the embossing body, and the obtuse summits of which face away from the hard surface of the embossing body, the first plurality of obtuse pyramids being intended to emboss the recesses of the first grating by exerting pressure on a first side of the planar material, the first plurality of obtuse pyramids forming first intermitted lines (row1, row2) corresponding to the intended recesses, and the pyramids in each subset corresponding to one of the first intermitted lines, being separated from each other between their bases by a determined distance that creates a gap in the line in such a manner that each gap from a line of pyramids may be connected to a corresponding gap from an adjacent line of pyramids by an imaginary line perpendicular to both of the adjacent lines; and roughening portions of the hard surface of the embossing body, the portions being located between adjacent lines of pyramids and intersecting at least one of the imaginary lines that connect one gap from one line to the corresponding gap from the adjacent line. The method further comprises on the counter embossing body providing a second plurality of obtuse pyramids with respective rhomboid-shaped bases which are on the hard surface of the counter embossing body, and the obtuse summits of which face away from the hard surface of the counter embossing body, the second plurality of obtuse pyramids being intended to emboss the ridges of the first grating by exerting pressure on a second side of the planar material opposite to the first side, the second plurality of obtuse pyramids forming second intermitted lines (row3, row4) corresponding to the intended ridges, and the pyramids in each subset corresponding to one of the second intermitted lines, being separated from each other between their bases by the determined distance, and the pyramids being positioned on their respective second intermitted lines in such a manner that during embossing their obtuse summits press the planar material against a roughened portion of the hard surface of the embossing body, thereby satinizing the top surfaces of the ridges on the first side.

In a preferred embodiment, the method further comprises embossing a second grating enclosed in a determined perimeter delimiting an image, whereby alternating and substantially parallel ridges and recesses of the second grating are in a first determined angle to the ridges and recesses of the first grating. The method comprises on the embossing body providing a third plurality of obtuse pyramids with rhomboid shaped bases in a similar manner as providing the first plurality of obtuse pyramids but according to third intermitted lines corresponding to the recesses to emboss of the second grating, in a first area of the hard surface of the embossing body, corresponding to the enclosure of the determined perimeter, instead of providing obtuse pyramids from the first plurality; and roughening portions of the hard surface of the embossing body, that are located between adjacent lines of pyramids inside the enclosure of the determined perimeter, in a manner similar as described for the first plurality of pyramids but adapted to positions of the third plurality of pyramids. The method further comprises on the counter embossing body providing a fourth plurality of obtuse pyramids with rhomboid shaped bases in a similar manner as providing the second plurality of obtuse pyramids but according to fourth intermitted lines corresponding to the intended ridges to emboss of the second grating, in a second area of the hard surface of the counter embossing body, corresponding to the enclosure of the determined perimeter, instead of providing obtuse pyramids from the second plurality.

In a further preferred embodiment the embossing body and the counter embossing body are configured to cooperate amongst each other in a planar embossing process, whereby the embossing body comprises any one of the list comprising a 2 dimensional surface, a surface exhibiting 3D structures, an undulated surface.

In a further preferred embodiment the embossing body and the counter embossing body are configured to cooperate amongst each other as rollers in a roller embossing process.

In a further preferred embodiment the rollers are synchronized among each other by means of toothed wheels.

In a further preferred embodiment the planar material is a metal foil.

In a further preferred embodiment the planar material is metal coated on the first side.

In a further preferred embodiment the hard surface comprises a hard coating.

In a further preferred embodiment the hard coating comprises TaC.

In a further preferred embodiment the roughening comprises a treatment of the hard surface with a focused pico- or femto-second laser in order to produce elevated microstructures.

In a further preferred embodiment the determined distance is null.

In a second aspect, the invention provides a device for embossing a first grating in a planar material, by means of an embossing body and a counter embossing body having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses. The device comprises on the embossing body a first plurality of obtuse pyramids with respective rhomboid-shaped bases which are on the hard surface of the embossing body, and the obtuse summits of which face away from the hard surface of the embossing body, the first plurality of obtuse pyramids being intended to emboss the recesses of the first grating by exerting pressure on a first side of the planar material, the first plurality of obtuse pyramids forming first intermitted lines (row1, row2) corresponding to the intended recesses, and the pyramids in each subset corresponding to one of the first intermitted lines, being separated from each other between their bases by a determined distance that creates a gap in the line in such a manner that each gap from a line of pyramids may be connected to a corresponding gap from an adjacent line of pyramids by an imaginary line perpendicular to both of the adjacent lines; and roughed portions of the hard surface of the embossing body, that are located between adjacent lines of pyramids and intersect at least one of the imaginary lines that connect one gap from one line to the corresponding gap from the adjacent line. The device further comprises on the counter embossing body a second plurality of obtuse pyramids with respective rhomboid-shaped bases which are on the hard surface of the counter embossing body, and the obtuse summits of which face away from the hard surface of the counter embossing body, the second plurality of obtuse pyramids being intended to emboss the ridges of the first grating by exerting pressure on a second side of the planar material opposite to the second side, the second plurality of obtuse pyramids forming second intermitted lines (row3, row4) corresponding to the intended ridges, and the pyramids in each subset corresponding to one of the second intermitted lines, being separated from each other between their bases by the determined distance, and the pyramids being positioned on their respective second intermitted lines in such a manner that during embossing their obtuse summits press the planar material against a roughened portion of the hard surface of the embossing body, thereby satinizing the top surfaces of the ridges on the first side.

In a further preferred embodiment the device is adapted for embossing a second grating enclosed in a determined perimeter delimiting an image, whereby alternating and substantially parallel ridges and recesses of the second grating are in a first determined angle to the ridges and recesses of the first grating. The device comprises on the embossing body a third plurality of obtuse pyramids with rhomboid shaped bases in a similar manner as the first plurality of obtuse pyramids but according to third intermitted lines corresponding to the recesses to emboss of the second grating, in a first area of the hard surface of the embossing body, corresponding to the enclosure of the determined perimeter, instead of having obtuse pyramids from the first plurality; and roughed portions of the hard surface of the embossing body, that are located between adjacent lines of pyramids inside the enclosure of the determined perimeter, in a manner similar as described for the first plurality of pyramids but adapted to positions of the third plurality of pyramids. The device further comprises on the counter embossing body a fourth plurality of obtuse pyramids with rhomboid shaped bases in a similar manner as providing the second plurality of obtuse pyramids but according to fourth intermitted lines corresponding to the intended ridges to emboss of the second grating, in a second area of the hard surface of the counter embossing body, corresponding to the enclosure of the determined perimeter, instead of having obtuse pyramids from the second plurality.

In a further preferred embodiment the embossing body and the counter embossing body are configured to cooperate amongst each other in a planar embossing process, whereby the embossing body comprises any one of the list comprising a 2 dimensional surface, a surface exhibiting 3D structures, an undulated surface.

In a further preferred embodiment the embossing body and the counter embossing body are configured to cooperate amongst each other as rollers in a roller embossing process.

In a further preferred embodiment the rollers are synchronized among each other by means of toothed wheels.

In a further preferred embodiment the planar material is a metal foil.

In a further preferred embodiment the planar material is metal coated on the first side.

In a further preferred embodiment the hard surface comprises a hard coating.

In a further preferred embodiment the hard coating comprises TaC.

In a further preferred embodiment the roughed surface results from a treatment of the hard surface with a focused pico- or femto-second laser in order to produce elevated microstructures.

In a further preferred embodiment the determined distance is null.

In a third aspect the invention provides a method for embossing a first grating in a planar material, by means of an embossing body and a counter embossing body having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses. The embossing body comprises a first plurality of obtuse pyramids with respective rhomboid-shaped bases which are on the hard surface of the embossing body, and the obtuse summits of which face away from the hard cylindrical surface of the embossing body, the first plurality of obtuse pyramids being intended to emboss the recesses of the first grating by exerting pressure on a first side of the planar material, the first plurality of obtuse pyramids forming first intermitted lines (row1, row2) corresponding to the intended recesses, and the pyramids in each subset corresponding to one of the first intermitted lines, being separated from each other between their bases by a determined distance that creates a gap in the line in such a manner that each gap from a line of pyramids may be connected to a corresponding gap from an adjacent line of pyramids by an imaginary line perpendicular to both of the adjacent lines; roughed portions of the hard surface of the embossing body, that are located between adjacent lines of pyramids and intersect at least one of the imaginary lines that connect one gap from one line to the corresponding gap from the adjacent line. The counter embossing body comprises a second plurality of obtuse pyramids with respective rhomboid-shaped bases which are on the hard surface of the counter embossing body, and the obtuse summits of which face away from the hard surface of the counter embossing body, the second plurality of obtuse pyramids being intended to emboss the ridges of the first grating by exerting pressure on a second side of the planar material opposite to the first side, the second plurality of obtuse pyramids forming second intermitted lines (row3, row4) corresponding to the intended ridges, and the pyramids in each subset corresponding to one of the second intermitted lines, being separated from each other between their bases by the determined distance, and the pyramids being positioned on their respective second intermitted lines in such a manner that during embossing their obtuse summits press the planar material against one of the roughed portion of the hard surface of the embossing roller, thereby satinizing the top surfaces of the ridges. The method comprises embossing the planar material with the embossing body and the counter embossing body.

In a further preferred embodiment the method is further for embossing a second grating enclosed in a determined perimeter delimiting an image, whereby alternating and substantially parallel ridges and recesses of the second grating are in a first determined angle to the ridges and recesses of the first grating. The embossing body further comprises a third plurality of obtuse pyramids with rhomboid shaped bases in a similar manner as providing the first plurality of obtuse pyramids but according to third intermitted lines corresponding to the recesses to emboss of the second grating, in a first area of the hard surface of the embossing body, corresponding to the enclosure of the determined perimeter, instead of providing obtuse pyramids from the first plurality; roughed portions of the hard surface of the embossing body, that are located between adjacent lines of pyramids inside the enclosure of the determined perimeter, in a manner similar as described for the first plurality of pyramids but adapted to positions of the third plurality of pyramids. The counter embossing body further comprises a fourth plurality of obtuse pyramids with rhomboid shaped bases in a similar manner as providing the second plurality of obtuse pyramids but according to fourth intermitted lines corresponding to the intended ridges to emboss of the second grating, in a second area of the hard surface of the counter embossing body, corresponding to the enclosure of the determined perimeter, instead of having obtuse pyramids from the second plurality.

BRIEF DESCRIPTION OF THE FIGURES

The invention will be better understood from the following detailed description of preferred embodiments and in light of the drawings, wherein.

Same references that are used throughout different figures correspond to same or similar features.

DETAILED DESCRIPTION OF PREFERRED EMBODIMENTS

Transitory Pictures—State of the Art

Figure 1:
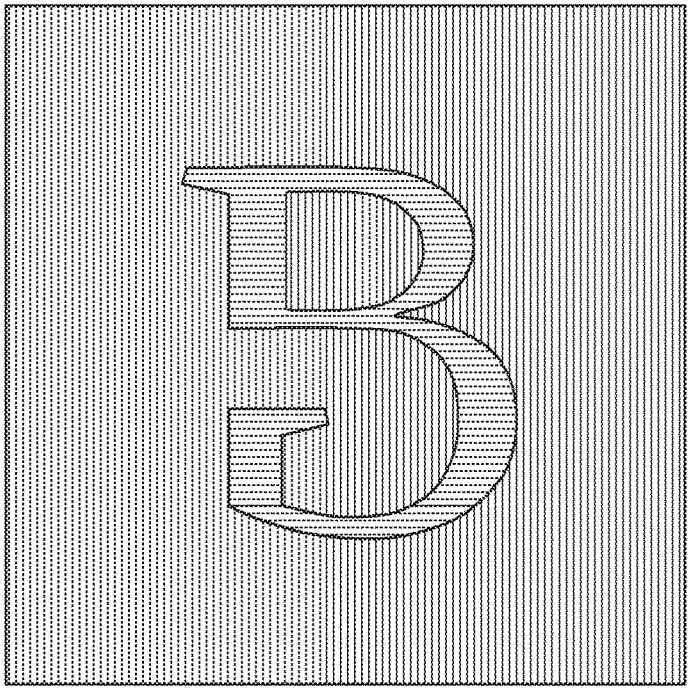
Prior Art FIG.1
FIG. 1 shows an intaglio printing of a logo according to prior art.
Figure 2:
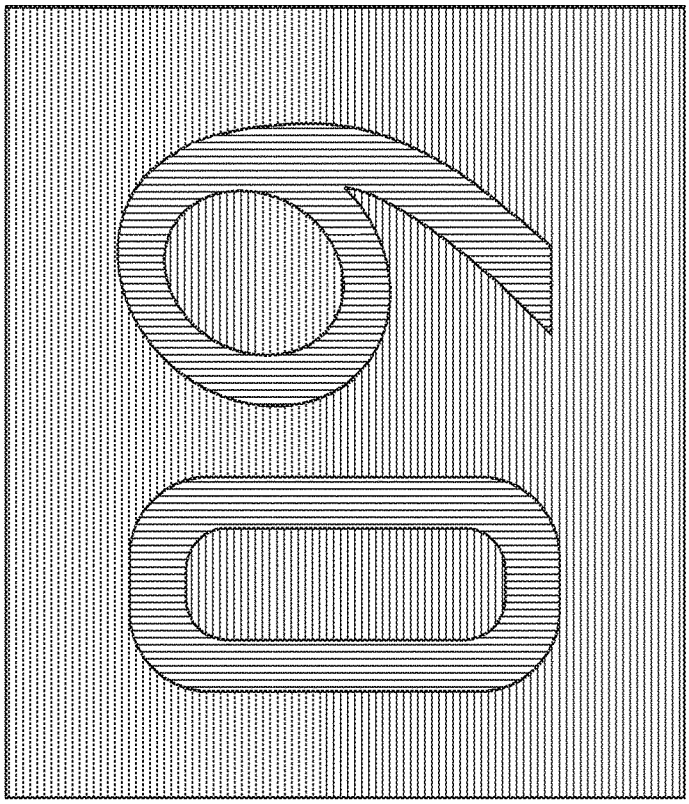
Prior Art FIG.2
FIG. 2 shows another intaglio printing of the number "60" according to prior art.
Figure 3:
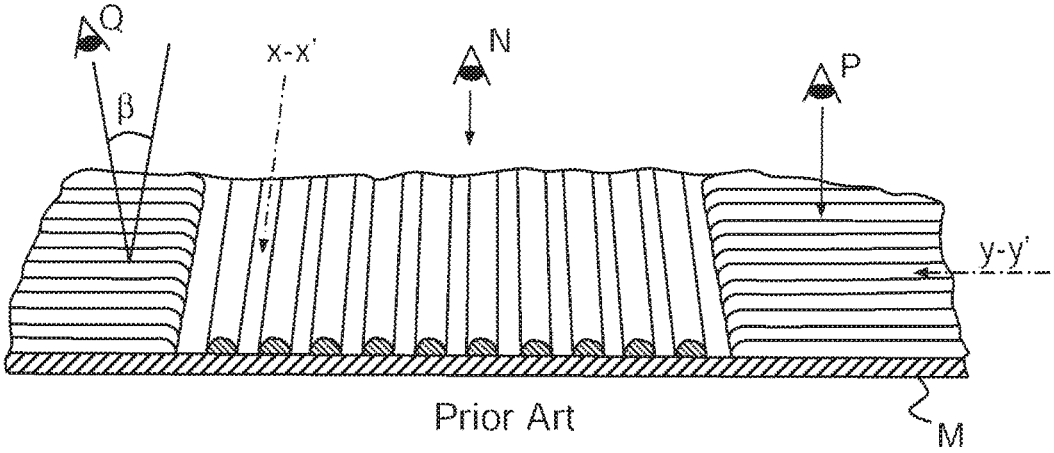
Prior Art FIG.3
FIG. 3 shows a sectional view of an intaglio print by means of line structures according to prior art.
Figure 4:
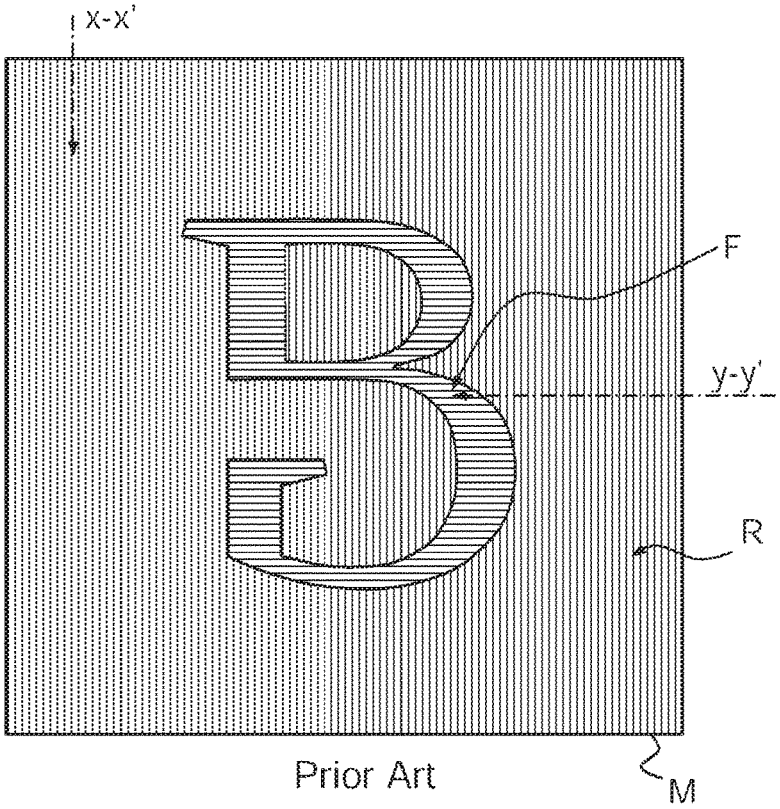
Prior Art FIG.4
FIG. 4 shows a logo intaglio printing made by means of line structures according to prior art.
Figure 5:
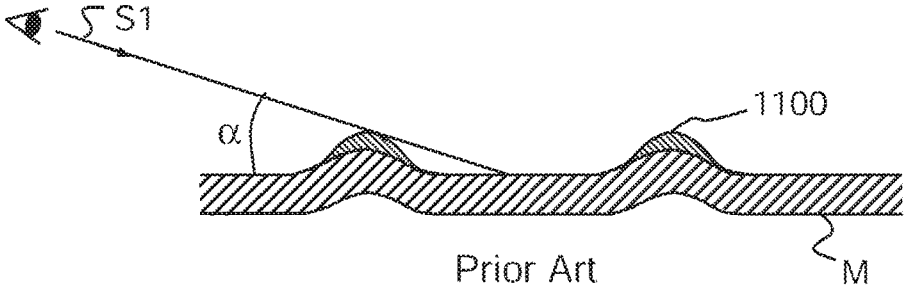
Prior Art FIG.5
FIG. 5 shows a partial sectional view of an embossed version of the intaglio from FIG. 4 according to prior art.

The state of the art may be understood for example from a simple transitory image made according to the intaglio technique as illustrated in FIGS. 3, 4 and 5. The transitory image comprises a background R (see FIG. 4) with lines aligned according to a direction x-x' and a BG-logo referenced in the figure with the letter F with lines aligned according to a direction y-y. In the example of FIG. 4 the direction x-x' is in angle of 90° to direction y-y'

FIG. 3 shows a principle of function for the classical making of transitory images by means of line structures that are on a colored but non-metal-coated white film M.

FIG. 4 illustrates the background R by means of the parallel lines aligned according to direction x-x'. A number of the latter lines are shown in an idealized manner in FIG. 3, and in a more realistic manner in FIG. 5. The lines illustrated in FIG. 5 are shown in a lateral section and as produced in intaglio printing, whereby an upper part 1100 of the structured lines is colored with ink. Concerning the second latent image, the logo uniting the letters "b" and "g" (referred to as the BG-logo in the following), the lines run perpendicular to the former lines, according to the direction y-y'.

In the following, three viewing positions are described that provide particularly distinguished views, i.e., either the background R, the logo F, or a uniform grey surface of the film M, also referred to as image plane.

Optical Effects

When viewing perpendicularly to the image plane or film M, e.g., as represented in FIG. 3 by an eye of an observer N, respectively P, the observer sees both line structures according to directions x-x' and y-y' as appearing uniformly grey.

Hence the observer gets the impression of the image of the BG-logo mixing with the grey background R that surrounds it.

Referring to FIG. 5, in case an observer S1 leaning in an angle α relative to the image plane or film M, she/he may see the recessed white stripes from the white coated film M between the colored upper parts 1100 of the line structures, respectively black line structures colored on the upper part 1100. In contrast, the colored lines are not well visible, as these are colored, for example in black, and hence are light absorbing. Hence the background is visible. If the observer leaves the angle α, the strong contrast of the background R vanishes.

Referring again to FIG. 3, a switch of images between the background R and the logo F may be achieved by having an observer Q leaning parallel to line direction x-x' but perpendicular to line direction y-y', in an angle β as compared to the direction x-x'. If β has approximately the same value as α, the observer Q sees the image of the BG-logo (logo F), while at the same time the line structures x-x' lay in the background and appear to be grey.

Transitory Images Using Embossed Metal Coated Planar Material

It is apparent from the afore given explanations that the intaglio print of line structures causes light to be absorbed dependent from an angle of incidence and/or viewing. If this were not the case, it would not be possible to switch between images.

In order to achieve esthetically more pleasing images it is desirable to use a metal coated planar material, as this allows to obtain nearly perfect mirroring effects, especially as compared to the white coated film M of FIGS. 3 to 5.

Furthermore it is imperative to produce a tilt dependent contrast.

It is known from the international publication WO 2015/028939 A1, that when embossing according to the Pater Mater (male female embossing) process, the contrast, or the clear recognizability of free surfaces can be improved with in part elevated flat surfaces of any form, in this case called facets or polygons, which are raised on the male die roller or recessed on the female die roller. The facets mark the individual surface parts and are designed through size and arrangement such that because of the higher specific embossing print, great brilliance and thus a good aesthetic impression of the total embossing is created. This impression is created through the image processing of the human eye with the help of refraction edges, which cause a locally elevated embossing print.

In prior art, the Pater Mater embossing tools are paired by means of etching or mechanically manufactured with a relative large amount of effort. A method for making elevated and/or depressed structures involves for example making use of the teachings from WO 2015/028939 A1 and WO 2013/041430.

It has for example been found while developing absorbing layers (mattings) that may be obtained by means of embossing, that a pixelation occurs. This term will be better understood in view of FIGS. 10 and 11 and the accompanying explanation herein below.

Embossing Tools for Producing Transitory Pictures

As is explained in WO 2015/028939 A1 and WO 2013/041430, it is already possible to form fine 3-dimensional structures in the range of 10 μm to 100 μm by means of short pulsed laser erosion on roller surfaces of steel.

Figure 8:
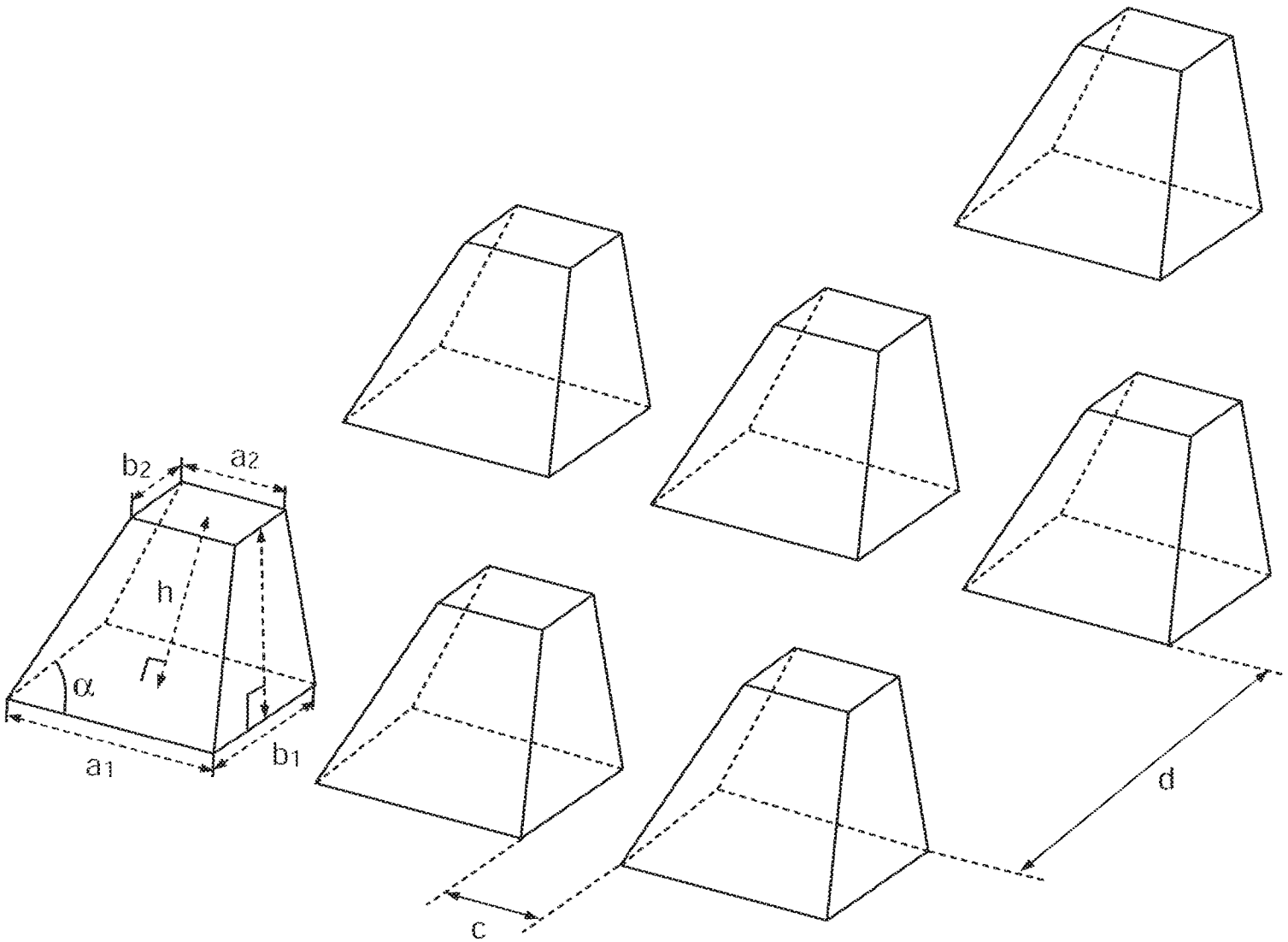
FIG. 8 illustrates an example grid of pyramids to be provided on an embossing body with dimensions according to an example embodiment of the invention.

FIG. 8 schematically illustrates an example grid of obtuse pyramids to be provided on an embossing body according to the present invention, with example dimensions. The obtuse pyramids are overly simplified in the view of FIG. 8—it is for example not clearly illustrated that the bases of the pyramids are rhomboid, but this feature will be discussed in more detail in the course of this description. The pyramids are intended for embossing line structures, which are thus represented here in an interrupted manner for reasons relating to embossing. In other words the line structures to be embossed are realized by embossing shorter and successive sections of that whole line.

Example dimensions for the illustrated rhomboid based obtuse pyramids are:

$a_1$=120 μm $a_2$=80 μm $b_1$=70 μm $b_2$=50 μm h=55 μm

α=45°

A distance c separating two pyramids of one line by their bases may for example be c=40 μm A further distance d separating two pyramids between two adjacent lines of pyramids may for example be d=120 μm In a preferred embodiment the sides of the rhomboid shaped bases which are directed along the line structure to emboss, are substantially parallel to the line structure. More particularly this concerns lines referenced with dimension $a_1$.

When embossing planar material—as will be explained in more detail later on in this description—it is possible that the required pressures lead to rubbed-off parts of the planar material, that should not remain around in the grid and here are evacuated through gaps separating the obtuse pyramids.

It is noted that as a number of embossing elements increases, unique embossing images are obtained that have a high level of copy protection.

In a further preferred embodiment not illustrated in the figures, the distance separating two pyramids of one line by their bases may be null. In fact the pyramids may in this case be formed such that neighboring pyramids adjoin to form a continuous line.

Pixelation

It results from the foregoing that the line structure requires contrasts which may not be provided with ink because of the degree of fineness, nor may they be provided by means of prior art embossing, such as for example the classical satinizing.

According to an example embodiment of the invention, a satin effect on metal coated planar material may be obtained through pinup-pinup embossing which on a significant surface of the embossed line structures changes the otherwise mirror like reflecting metal surface in such a manner to refract incoming light such that this is reflected in a diffuse fashion. As a result the human eye viewing at a distance of 30 cm does not anymore see any details of lines.

Figure 10:
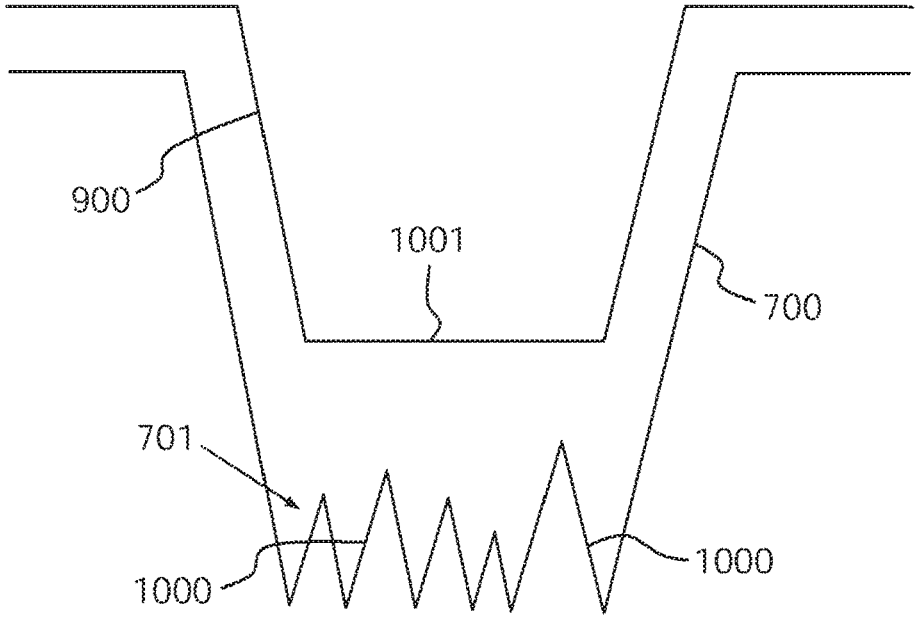
FIG. 10 contains a schematic illustration of a side view between 2 pyramids of FIG. 9, to explain means for roughening as used in an example embodiment of the invention.
Figure 11:
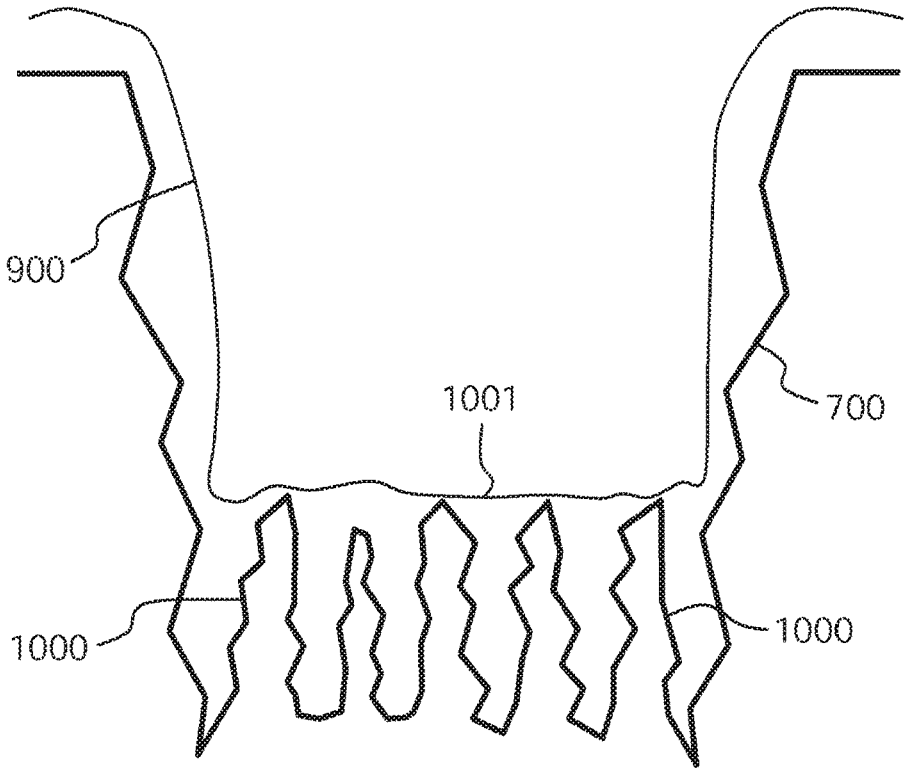
FIG. 11 contains a more realistic view of the side view illustrated in FIG. 10.

Using newly developed short pulsed laser structuring processes—such as for example the ones described in the not yet published European patent application EP15201862—it has become possible to make surface structures in the range of 10 μm. These structures may for example be used to emboss the metal side of a metal coated planar material in order to produce a pronounced local satinizing effect due to a so-called micro-satinizing effect. FIGS. 10 and 11 show structures 1000 made by the short pulsed laser structuring process on the hard surface of the embossing roller. The structures 1000 result from so-called pixelation of the surface, i.e., miniature pyramids or elevation with a height of approximately 15 μm.

While the surface of the embossing roller is here said to be hard, it may in fact also be a surface with a hard coating.

Figure 7A:
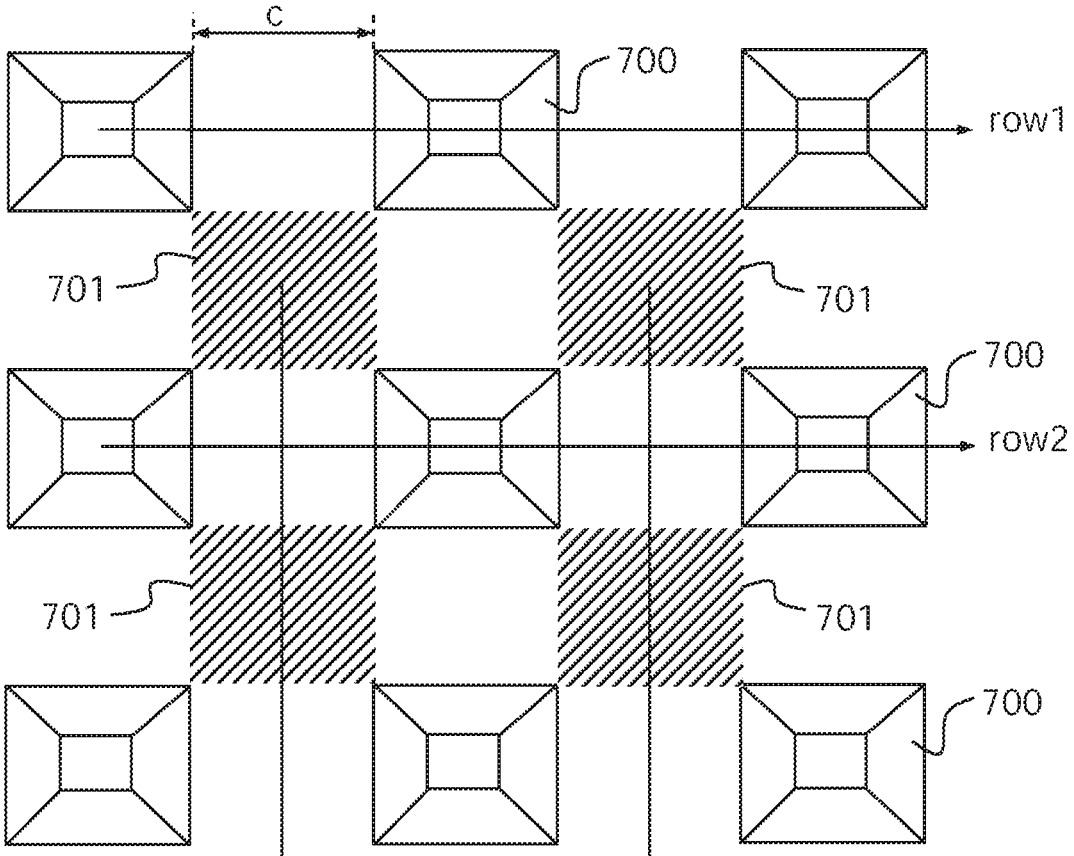
FIGS. 7*a* and 7*b* schematically show pyramids as positioned on an embossing body and a counter embossing body according to an example embodiment of the invention.

FIG. 7*a* illustrates a very simplified view from above towards an embossing body surface on which a plurality of obtuse pyramids 700 are made in a grid. Arrows labeled row1 and row2 indicate lines, to each one of which a subset of obtuse pyramids belongs. These lines row1 and row2 are lines corresponding to the intended grating structure to be embossed. Lines row1 and row2 and all subsequent similar lines of obtuse pyramids are substantially parallel to each other. Similarly as in FIG. 8, the pyramids are separated at their base from the next pyramid in the same line by a gap of determined length labeled here as c. The obtuse pyramids 700 are placed such that from one line to the next line a gap between two pyramids can be connected to a gap between two other pyramids on an adjacent parallel line by an imaginary perpendicular line, such as lines row1' and row2'. Roughed portions 701 of surface are created between two adjacent lines of pyramids, whereby the roughted portions 701 intersect with the imaginary perpendicular lines row1, row2', . . . . The roughed portions 701 contain structures 1000 (not illustrated in FIG. 7*a*) like the ones shown in FIGS. 10 and 11.

Figure 9:
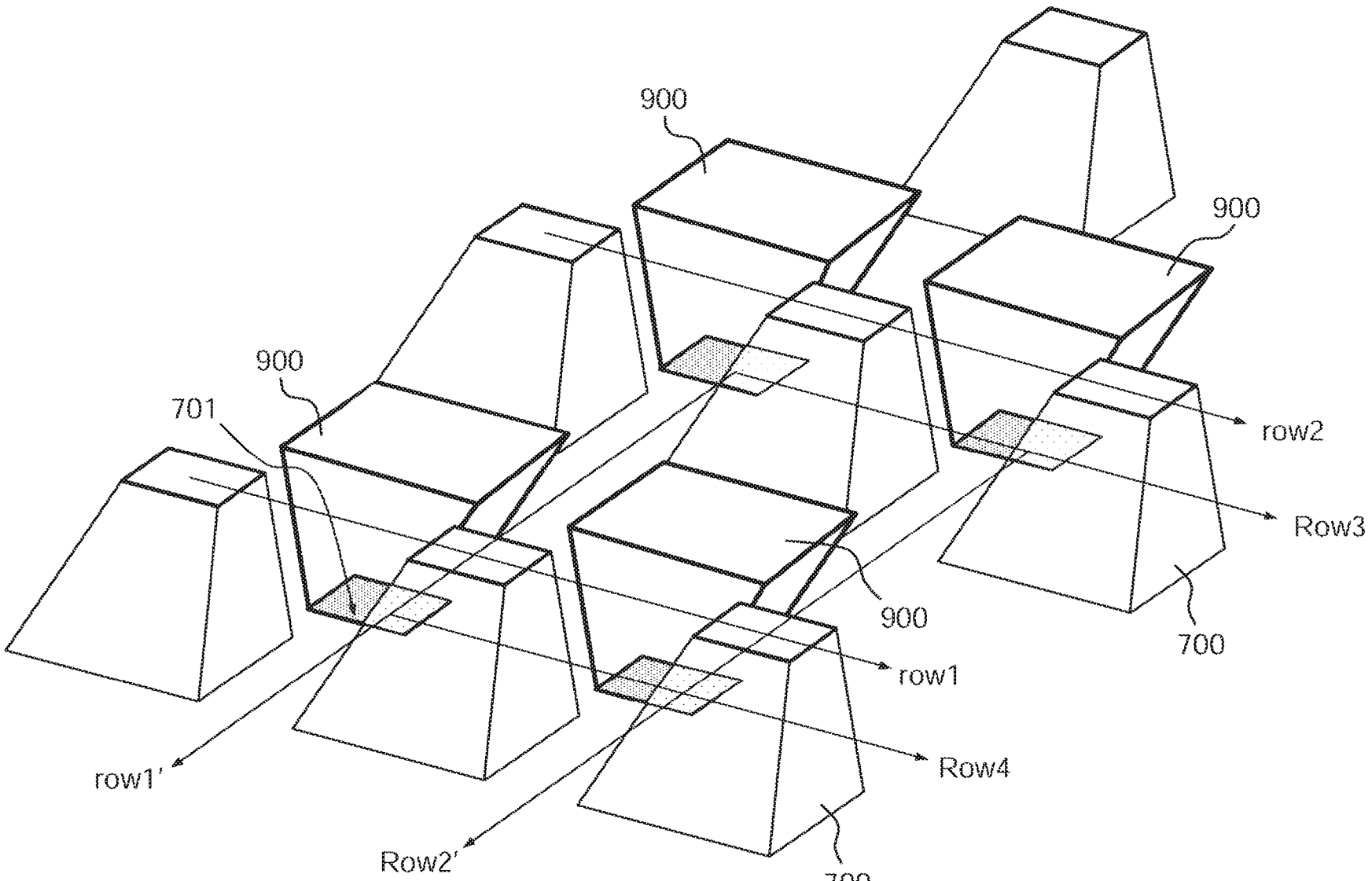
FIG. 9 illustrates an example of pyramids provided on an embossing body and a counter embossing body, as intertwined at the time of embossing according to an example embodiment of the invention.

Turning now to FIG. 9, this illustrates obtuse pyramids 700 as known from FIG. 8 or 7*a*, the bases of which are in a grid and in lines on a hard surface of the embossing body (not illustrated). Again obtuse pyramids are in lines such as row1 and row2. There may of course be many more lines, and the number of obtuse pyramids in a line may vary depending on the dimensions of the grating structures to be embossed. FIG. 9 further illustrates obtuse pyramids 900 which intertwine with obtuse pyramids 700 at a time of embossing. Obtuse pyramids 900 are arranged on a hard surface of a counter embossing body (not illustrated in FIG. 9). Obtuse pyramids 900 are further arranged in lines row3 and row4 that are intended to be parallel to lines row1 and row2 at the time of embossing. The obtuse pyramids 900 are further positioned in such a manner that their obtuse extremities will exert pressure on a planar material to be embossed (not illustrated in FIG. 9) and cause the structure of roughed surfaces 701 to be embossed in the planar material, e.g., the metal coated side of the planar material. Hence the obtuse extremities of obtuse pyramids 900 are aligned on lines row1' and row2' at the time of embossing.

Figure 7B:
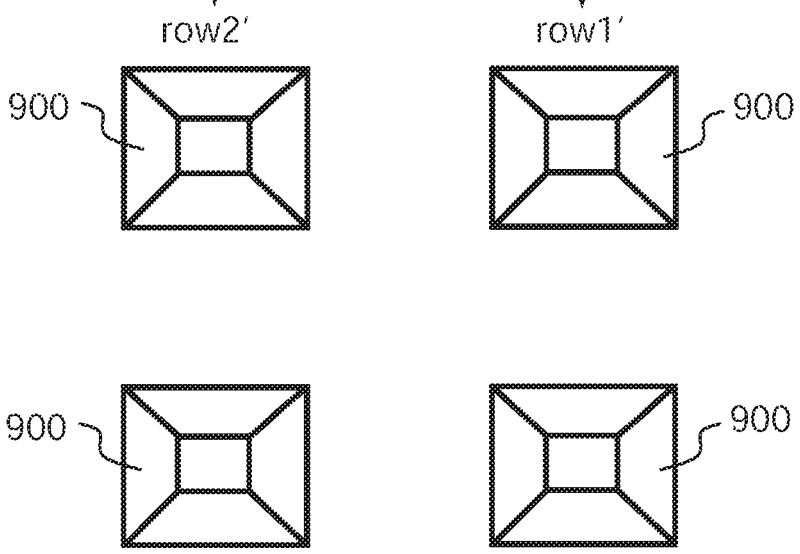

Returning now to FIG. 7*b* this illustrates four of the obtuse pyramids 900 next to the pyramids of FIG. 7*a*, which does not correspond to an actual real relative positioning, but is given to better understand how the grid of obtuse pyramids 900 is configured compared to the grid of obtuse pyramids 700. It is understood that at a time of embossing the obtuse pyramids 900 and 700 intertwine as shown in FIG. 9 for example.

Returning now to FIG. 10, this schematically illustrates how the obtuse extremity 1001 of an obtuse pyramid 900 is positioned above the roughed surface 701 and its structures 1000 at a time of embossing.

FIG. 11 shows the schematically illustrated features of FIG. 10 in a more realistic way where the surfaces of the pyramids 900 and 700, and structures 1000 may not necessarily be perfectly plane.

Figure 12:
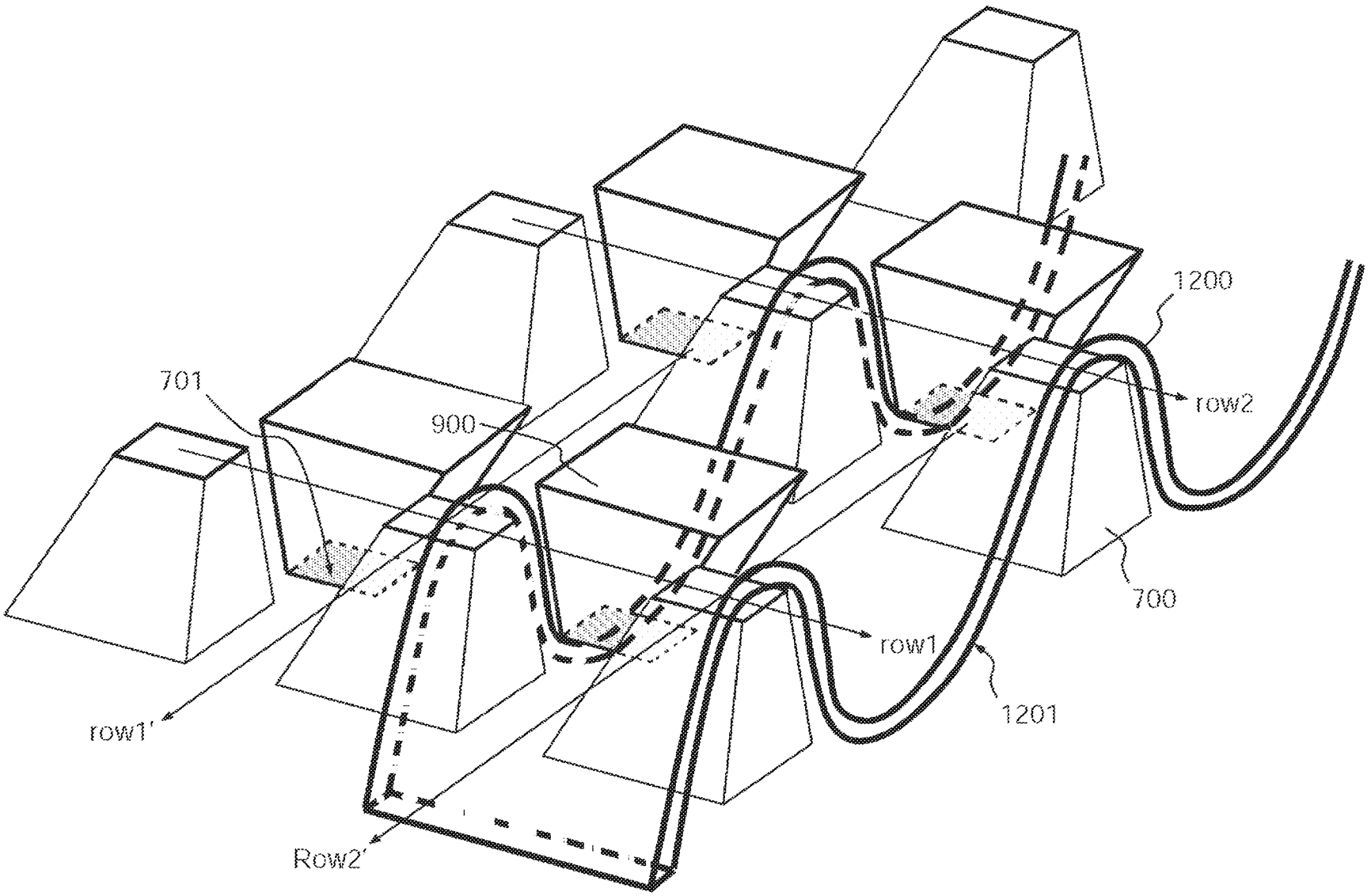
FIG. 12 corresponds to the intertwined pyramids of FIG. 9 with a piece of planar material being embossed.

FIG. 12 shows obtuse pyramids 700 and 900 as in FIG. 9, thus positioned at a time of embossing, but with a piece of metal coated planar material 1200—used here as an example only—positioned to be embossed. A metal coated side 1201 of planar material 1200 is oriented towards the obtuse pyramids 700, and hence the metal coated side 1201 is pressed by obtuse pyramids 900 against roughed surfaces 701 to obtain a satinizing effect producing surface.

Figure 13:
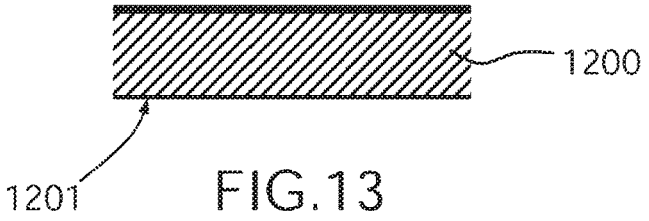
FIG. 13 illustrates a cross-sectional view of a piece of planar material to be embossed according to an example of the invention.

FIG. 13 show a piece of planar material 1200 in lateral section, and its metal coated side 1201 (schematically only).

Returning for FIG. 12, when being embossed in this manner, the grating to be embossed is produced as follows: the obtuse pyramids 700 emboss recesses of the grating which keep the metal coating intact to produce a mirror like reflecting surface; the obtuse pyramids 900 emboss ridges of the grating which are satinized by the embossing of the structures 1000 (structures not represented in FIG. 12 for a better reading of the figure) from roughed surfaces 701, hence modifying the surface of the ridges in such a manner that the metal coating produces a satinizing effect on light that would be reflected by the ridge. In effect the satinizing effect weakens a direct angular reflection of light that would fall on the satinized ridges of the ready embossed product, by producing a diffuse omnidirectional reflection (not illustrated in FIG. 12).

Figure 6:
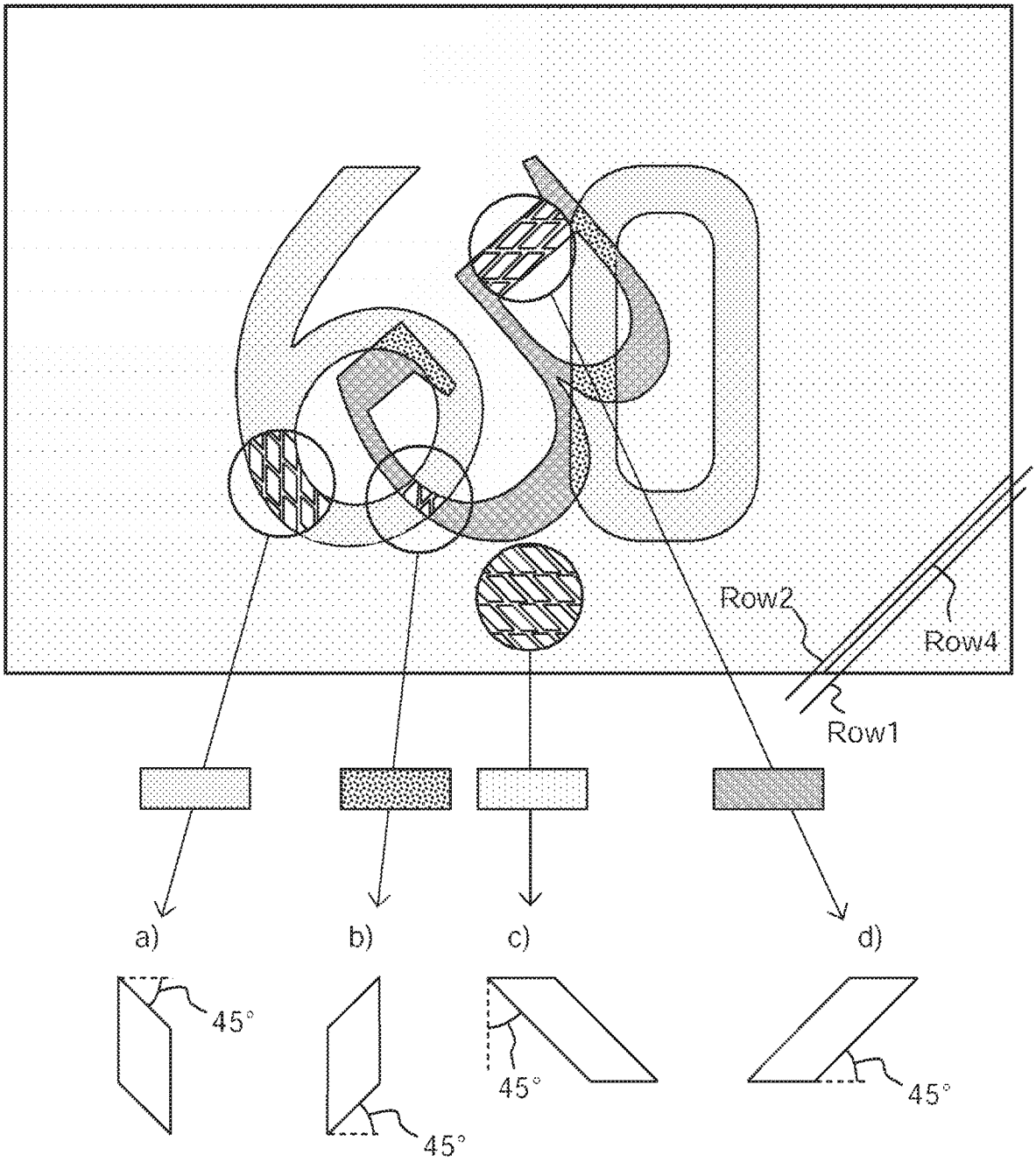
FIG. 6 shows an example embossing to be produced according to the invention.

FIG. 6 shows an example of gratings to be embossed by means of an embossing body, with the method and device of the present invention, including a grating for the background and different gratings for the two images—the number 60 and the BG-logo—whereby the different gratings have structures of ridges and recesses that are at specific set angles relative to the grating of the background or the gratings of the images or intersection thereof as appropriate. More precisely zones a)-d) which are illustrated in different textures, represent zones having different gratings, i.e., zone a) has one type of grating, zone b) a type of grating at a different angle than that of zone a) etc. Each zone's grating is made in a similar manner except that the orientations of the lines vary. As an example in zone a) an arrangement of the rhomboid-shaped bases of the obtuse pyramids made on the hard surface of the embossing body (embossing body not shown here) is oriented on lines labelled Row1 and Row 2 drawn in one corner of the background, such as the ones illustrated in FIG. 9. For the counter embossing body corresponding pyramids would be placed on the hard surface of that counter embossing body according to line Row 4 for example in a manner as explained for FIG. 9.

The illustrations of lines of pyramids shown in circles drawn over zones a)-d) is for illustrative purposes only—notably the orientation shown in the circle for zone a) does not necessarily correspond to the Row1 and Row2. However the effect of the illustration is to show that the orientation of the rhomboid pyramids is along lines that are in different angles from one zone to another zone. A number of orientations of the rhomboid shapes of the pyramids is given by way of example with angles of 45° as illustrated at a bottom part of FIG. 6 below letters a), b), c) and d).

Figure 16:
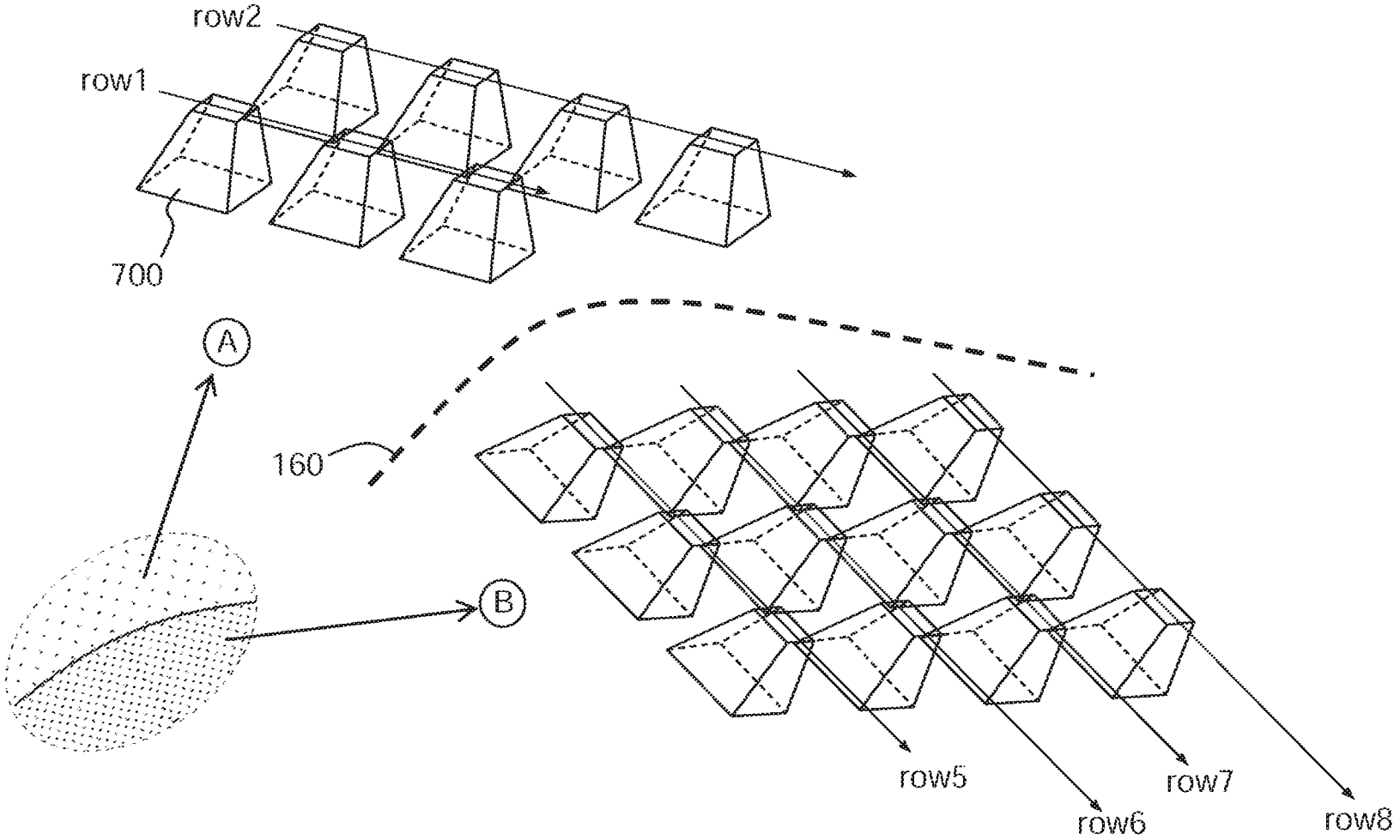
FIG. 16 illustrates the principle of having rows of pyramids from one zone to another zone in a determined angle to each other, according to an example embodiment of the invention.

Another illustration of principle is shown in FIG. 16, which shows the principle that the lines Row1 and Row2 of rhomboid pyramids 700 in a zone A from FIG. 6 are in a determined angle to lines Row5-Row8 of rhomboid pyramids in a neighboring zone B from FIG. 6. For reasons of better understanding a magnified excerpt of FIG. 6 showing neighboring zones A and B is also shown in FIG. 16. The zones A and B are separated at line 160 which is also inserted purely for illustrative and understanding reasons.

As already mentioned the arrangement of pyramids shown in FIG. 6 is for an embossing body. A corresponding counter embossing body (not illustrated) is needed in which obtuse pyramids are arranged such that at a time of embossing the pyramids intertwine in a manner as shown for example in FIG. 9.

A resulting embossed planar material (also not illustrated) contains zones of gratings corresponding to embossing zones a)-d) because having been produced by these zones, each zone producing a different effect when exposed to light that reflects on it. A viewing angle would thus reveal different reflected light intensities for every zone, such that by varying the viewing angle it is possible to discern either one of the images represented by the zones, i.e., the background for zone c), non-intersected parts of the number 60 for zone a), non-intersected parts of the logo BG for zone d) and intersections of the number 60 with the logo BG for zone d).

Embossment Bodies

The examples given above consistently make reference to embossing body and counter embossing body. For example in reference to the example illustrated in FIG. 9, the obtuse pyramids 700 are made on a hard surface of an embossing body (not illustrated) whereas the obtuse pyramids 900 are made on a hard surface of a counter embossing body (also not illustrated). Hence the embossing body and the counter embossing body cooperate at a time of embossing the planar material. The method for embossing a first grating, and perhaps also an optional second grating includes providing an embossing body with a first plurality of obtuse pyramids 700 and a counter embossing body with a second plurality of obtuse pyramids 900.

Various actual embodiments are possible for the embossing bodies.

Figure 14:
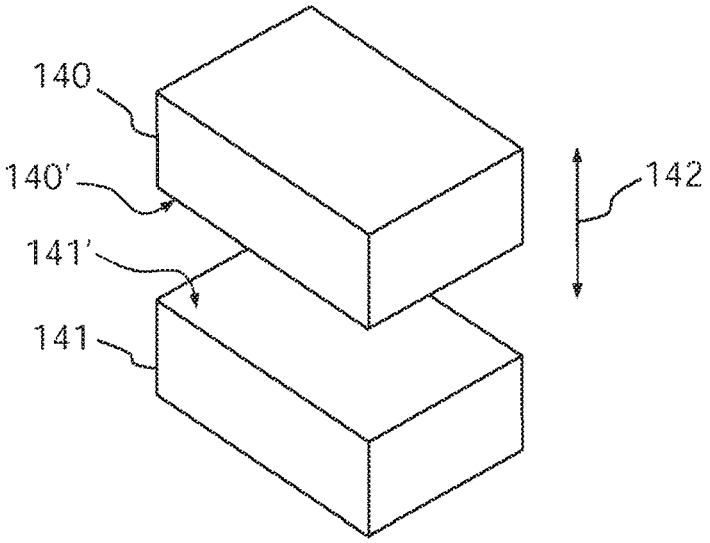
FIG. 14 illustrates schematically a configuration in which the embossing body and the counter embossing body are configured to cooperate amongst each other in a planar embossing process according to an example embodiment of the invention.

In one preferred embodiment, the embossing body and the counter embossing body are configured to cooperate amongst each other in a planar embossing process. In other word the surface of the embossing body and the surface of the counter embossing surface on which respectively the obtuse pyramids are made, are substantially plane. FIG. 14 illustrates schematically a configuration in which the embossing body 140 and the counter embossing body 141 each have substantially plane surfaces 140' and 141' on which the obtuse pyramids are made (pyramids not illustrated in the figure). The embossing body 140 may be moved towards or away from counter embossing body 141 along a direction illustrated by double arrow 142. This is an example only of how the bodies may be moved relatively to each other. At the time of embossing, the planar material is positioned between the embossing body 140 and the embossing body 141.

In further preferred embodiments of the planar embossing process, the embossing body comprises any one of the list comprising a 2 dimensional surface, a surface exhibiting 3D structures, an undulated surface.

Figure 15:
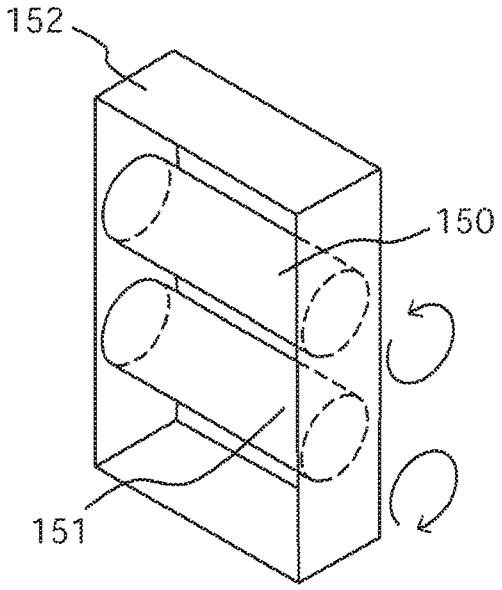
FIG. 15 illustrates schematically a configuration in which the embossing body and the counter embossing body are configured to cooperate amongst each other as rollers in a roller embossing process.

In another preferred embodiment illustrated schematically in FIG. 15, the embossing body 150 and the counter embossing body 151 are configured to cooperate amongst each other as rollers in a roller embossing process. The rollers 150 and 151 are mounted in a holder frame 152 and may turn according to circular arrows represented at an extremity of the rollers in FIG. 15. In a preferred embodiment the rollers are synchronized among each other by means of toothed wheels places for example at the extremities of the rollers, the toothed wheel of one roller cooperating with the toothed wheel of the other roller.

At the time of embossing, the planar material (not illustrated in the figure) is inserted and pulled in the gap between both rollers 150 and 151. The hard cylindrical surfaces of each roller 150 and 151 comprises obtuse pyramids as described herein above. For example obtuse pyramids 700 may be made on the cylindrical surface of embossing roller 150 and obtuse pyramids on the cylindrical surface of counter embossing roller 151 (pyramids not illustrated in the figure).

The hard surface of the embossing bodies is necessary to form the above discussed roughened surface, but also possibly the obtuse pyramids. Such surface may for example comprise TaC.

The roughening of the hard surface is preferably obtained by means of a treatment of the hard surface with a focused pico- or femto-second laser in order to produce elevated microstructures. Preferably the elevated microstructures are sized in the range of 10 to 15 μm.

SUMMARY

Method 1: A method for embossing a first grating in a planar material with an embossing body and a counter embossing body, the embossing body including, a first plurality of obtuse pyramids with respective rhomboid-shaped bases on a hard surface of the embossing body, obtuse summits of the respective first plurality of obtuse pyramids facing away from the hard surface of the embossing body, the first plurality of obtuse pyramids configured to emboss recesses of the first grating, the first plurality of obtuse pyramids forming first intermitted lines corresponding to the recesses, and the pyramids in each subset corresponding to one of the first intermitted lines, the first plurality of obtuse pyramids separated from each other at their bases by a determined distance that creates a gap in a corresponding first intermitted line such that each gap from a line of pyramids connects to a corresponding gap from an adjacent line of pyramids by an imaginary line perpendicular to both of the adjacent lines; and roughening portions of the hard surface of the embossing body, the portions located between adjacent lines of pyramids and intersecting at least one of the imaginary lines that connect one gap from one line to the corresponding gap from the adjacent line; and the counter embossing body including, a second plurality of obtuse pyramids with respective rhomboid-shaped bases on a hard surface of the counter embossing body, obtuse summits of the respective second plurality of obtuse pyramids facing away from the hard surface of the counter embossing body, the second plurality of obtuse pyramids configured to emboss the ridges of the first grating, the second plurality of obtuse pyramids forming second intermitted lines corresponding to the ridges, and the pyramids in each subset corresponding to one of the second intermitted lines, the second plurality of obtuse pyramids separated from each other at their bases by the determined distance, and the second plurality of pyramids being arranged on their respective second intermitted lines such that during embossing their obtuse summits press the planar material against the roughened portions of the hard surface of the embossing body, the method comprising the steps of:

feeding the planar material between the embossing body and the counter-embossing body;

embossing the planar material with the recesses of the first grating by exerting pressure on a first side of the planar material with the first plurality of obtuse pyramids, and embossing the planar material with the ridges of the first grating by exerting pressure on a second side of the planar material opposite to the first side with the second plurality of obtuse pyramids; and satinizing top surfaces of the ridges on the first side of the planar material by pressing the obtuse summits of the second plurality of obtuse pyramids against the planar material towards the roughened portions of the hard surface of the embossing body, wherein the first grating includes alternating substantially parallel and straight ridges and recesses, the top surfaces of the ridges configured to weaken a direct angular reflection of light by diffuse omnidirectional reflection to produce a visible contrast between the ridges and the recesses.

Method 2: The method 1, further comprising a step of:

embossing the planar material with a second grating in a determined perimeter delimiting an image, alternating and substantially parallel ridges and recesses of the second grating are in a first determined angle to the ridges and recesses of the first grating, the embossing body further including, a third plurality of obtuse pyramids with rhomboid shaped bases according to third intermitted lines corresponding to the recesses of the second grating, in a first area of the hard surface of the embossing body, corresponding to an area of the determined perimeter; and roughening portions of the hard surface of the embossing body, located between adjacent lines of pyramids inside the area of the determined perimeter, arranged at positions of the third plurality of pyramids;

the counter embossing body further including, a fourth plurality of obtuse pyramids with rhomboid shaped bases according to fourth intermitted lines corresponding to the ridges to emboss the second grating, in a second area of the hard surface of the counter embossing body, corresponding to the area of the determined perimeter.

Method 3: The method 1, wherein the embossing body and the counter embossing body are configured to cooperate amongst each other in a planar embossing process, whereby the embossing body comprises any one of the list comprising a 2 dimensional surface, a surface exhibiting 3D structures, an undulated surface.

Method 4: The method 1, wherein the embossing body and the counter embossing body are configured to cooperate amongst each other as rollers in a roller embossing process.

Method 4': The method 4, wherein the rollers are synchronized among each other by means of toothed wheels.

Method 5: The method 1, wherein the planar material is a metal foil.

Method 6: The method 1, wherein the planar material is metal coated on the first side.

Method 7: The method 1, wherein the hard surface includes a thermal adhesive coating.

Method 7': The method 1, wherein the hard surface comprises a hard coating.

Method 7": The method 7', wherein the hard coating comprises TaC

Method 8: The method 1, wherein the roughening is formed by a treatment of the hard surface with a focused pico- or femto-second laser in order to produce elevated microstructures.

Method 8': The method 1 wherein the determined distance is null

Device 9: A device for embossing a first grating in a planar material, the first grating having alternating substantially parallel and straight ridges and recesses, top surfaces of the ridges configured to weaken a direct angular reflection of light by diffuse omnidirectional reflection to produce a visible contrast between the ridges and the recesses, the device comprising:

an embossing body having a hard surface; and a counter embossing body having a hard surface, wherein the embossing body includes, a first plurality of obtuse pyramids with respective rhomboid-shaped bases on a hard surface of the embossing body, obtuse summits of the respective first plurality of obtuse pyramids facing away from the hard surface of the embossing body, the first plurality of obtuse pyramids configured to emboss recesses of the first grating, the first plurality of obtuse pyramids forming first intermitted lines corresponding to the recesses, and the pyramids in each subset corresponding to one of the first intermitted lines, the first plurality of obtuse pyramids separated from each other at their bases by a determined distance that creates a gap in a corresponding first intermitted line such that each gap from a line of pyramids connects to a corresponding gap from an adjacent line of pyramids by an imaginary line perpendicular to both of the adjacent lines;

roughening portions of the hard surface of the embossing body, the roughening portions being located between adjacent lines of pyramids and intersecting at least one of the imaginary lines that connect one gap from one line to the corresponding gap from the adjacent line; and the counter embossing body includes, a second plurality of obtuse pyramids with respective rhomboid-shaped bases on a hard surface of the counter embossing body, obtuse summits of the respective second plurality of obtuse pyramids facing away from the hard surface of the counter embossing body, the second plurality of obtuse pyramids being configured to emboss the ridges of the first grating, the second plurality of obtuse pyramids forming second intermitted lines corresponding to the ridges, and the pyramids in each subset corresponding to one of the second intermitted lines, the second plurality of obtuse pyramids separated from each other at their bases by the determined distance, and the second plurality of pyramids being arranged on their respective second intermitted lines such that during embossing their obtuse summits press the planar material against the roughened portions of the hard surface of the embossing body to satinize the top surfaces of the ridges on the first side.

Device 10: The device of device 9, further adapted for embossing a second grating in a determined perimeter delimiting an image, alternating and substantially parallel ridges and recesses of the second grating are in a first determined angle to the ridges and recesses of the first grating, the embossing body further including, a third plurality of obtuse pyramids with rhomboid shaped bases according to third intermitted lines corresponding to the recesses to emboss the second grating, in a first area of the hard surface of the embossing body, corresponding to an area of the determined perimeter;

roughed portions of the hard surface of the embossing body, located between adjacent lines of pyramids inside the area of the determined perimeter, adapted to positions of the third plurality of pyramids, the counter embossing body further including, a fourth plurality of obtuse pyramids with rhomboid shaped bases according to fourth intermitted lines corresponding to the ridges to emboss the second grating, in a second area of the hard surface of the counter embossing body, corresponding to the area of the determined perimeter.

Device 11: The device according to Device 9, wherein the embossing body and the counter embossing body are configured to cooperate amongst each other in a planar embossing process, whereby the embossing body comprises any one of the list comprising a 2 dimensional surface, a surface exhibiting 3D structures, an undulated surface.

Device 12: The device according to device 9, wherein the embossing body and the counter embossing body are configured to cooperate amongst each other as rollers in a roller embossing process.

Device 12': The device of device 12, wherein the rollers are synchronized among each other by means of toothed wheels Device 13: The device according to device 9, wherein the planar material is a metal foil.

Device 14: The device according to device 9, wherein the planar material is metal coated on the first side.

Device 15: The device according to device 9, wherein the hard surface includes a thermal adhesive coating.

Device 15': The device according to Device 9, wherein the hard surface comprises a hard coating.

Device 15": The device according to Device 15', wherein the hard coating comprises TaC Device 16: The device according to device 9, wherein the roughed surface is formed by a treatment of the hard surface with a focused pico- or femto-second laser in order to produce elevated microstructures.

Device 16': The device according to device 9, wherein the determined distance in null.

Device 17: A device of manufacturing an embossing body and a counter embossing body each having a hard surface, the embossing body and the counter embossing body configured to emboss a first grating in a planar material, the first grating including alternating substantially parallel and straight ridges and recesses, the top surfaces of the ridges configured to weaken a direct angular reflection of light by diffuse omnidirectional reflection to produce a visible contrast between the ridges and the recesses, the device comprising the steps of:

forming a first plurality of obtuse pyramids with respective rhomboid-shaped bases on the hard surface of the embossing body, obtuse summits of the plurality of obtuse pyramids face away from the hard cylindrical surface of the embossing body, the first plurality of obtuse pyramids configured to emboss the recesses of the first grating by exerting pressure on a first side of the planar material, the first plurality of obtuse pyramids forming first intermitted lines corresponding to the recesses, and the pyramids in each subset corresponding to one of the first intermitted lines, being separated from each other between their bases by a determined distance that creates a gap in the line such that each gap from a line of pyramids are connected to a corresponding gap from an adjacent line of pyramids by an imaginary line perpendicular to both of the adjacent lines;

forming roughed portions of the hard surface of the embossing body, located between adjacent lines of pyramids and intersect at least one of the imaginary lines that connect one gap from one line to the corresponding gap from the adjacent line;

forming a second plurality of obtuse pyramids with respective rhomboid-shaped bases on the hard surface of the counter embossing body, obtuse summits of the plurality of obtuse pyramids face away from the hard surface of the counter embossing body, the second plurality of obtuse pyramids configured to emboss the ridges of the first grating by exerting pressure on a second side of the planar material opposite to the first side, the second plurality of obtuse pyramids forming second intermitted lines corresponding to the ridges, and the pyramids in each subset corresponding to one of the second intermitted lines, being separated from each other at their bases by the determined distance, and the pyramids being positioned on their respective second intermitted lines such that during embossing their obtuse summits press the planar material against one of the roughed portion of the hard surface of the embossing roller, thereby satinizing the top surfaces of the ridges.

Device 18: The device of manufacturing according to device 17, the embossing body and the counter embossing body further used for embossing a second grating in a determined perimeter delimiting an image, alternating and substantially parallel ridges and recesses of the second grating are in a first determined angle to the ridges and recesses of the first grating, the device further comprising the steps of:

forming a third plurality of obtuse pyramids with rhomboid shaped bases according to third intermitted lines corresponding to the recesses to emboss the second grating, in a first area of the hard surface of the embossing body, corresponding to the area of the determined perimeter;

forming roughed portions of the hard surface of the embossing body, located between adjacent lines of pyramids inside the area of the determined perimeter, adapted to positions of the third plurality of pyramids;

forming a fourth plurality of obtuse pyramids with rhomboid shaped bases according to fourth intermitted lines corresponding to the ridges to emboss of the second grating, in a second area of the hard surface of the counter embossing body, corresponding to the area of the determined perimeter.

Device 19: The device according to device 18, further comprising a step of:

coating the hard surface with a thermal adhesive coating.

Device 20: The device according to device 18, wherein the step of forming the roughed portions is performed by a treatment of the hard surface with a focused pico- or femto-second laser to produce elevated microstructures.

What is claimed is:

1. A method for embossing a first grating in a planar material, by an embossing body and a counter embossing body, having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses, the method comprising:

providing a first plurality of pyramids with respective rhomboid-shaped bases on the hard surface of the embossing body, the first plurality of pyramids arranged in a first grid on the hard surface, and the summits of which face away from the hard surface of the embossing body, the first plurality of pyramids being intended to emboss the recesses of the first grating by exerting pressure on a first side of the planar material, the first plurality of pyramids forming first intermitted lines of the first grid corresponding to the intended recesses, and the pyramids in each subset corresponding to one of the first intermitted lines, being separated from each other between their bases by a determined distance that creates a gap in the line in such a manner that each gap from a line of pyramids may be connected to a corresponding gap from an adjacent line of pyramids by an imaginary line perpendicular to both of the adjacent lines;

roughening portions of the hard surface of the embossing body to form roughed portions, the roughed portions arranged in a second grid, the first grid and the second grid interspersed with each other such that the bases of the first plurality of pyramids and the roughed portions form a checkerboard pattern on the hard surface of the embossing body; and providing a second plurality of pyramids with respective rhomboid-shaped bases which are on the hard surface of the counter embossing body, the second plurality of pyramids arranged in a third grid on the hard surface, the summits of which face away from the hard surface of the counter embossing body, the second plurality of pyramids being intended to emboss the ridges of the first grating by exerting pressure on a second side of the planar material opposite to the first side, the second plurality of pyramids forming second intermitted lines of the third grid corresponding to the intended ridges, and the pyramids in each subset corresponding to one of the second intermitted lines, being separated from each other between their bases by the determined distance, and the pyramids being positioned on their respective second intermitted lines in such a manner that during embossing their summits press the planar material against corresponding roughed portions arranged in the second grid on the hard surface of the embossing body, thereby sanitizing the top surfaces of the ridges on the first side.

2. The method of claim 1, further comprising:

providing a third plurality of pyramids with rhomboid shaped bases according to third intermitted lines corresponding to the recesses to emboss of a second grating, the second grating enclosed in a determined perimeter delimiting an image, alternating and substantially parallel ridges and recesses of the second grating are in a first determined angle to the ridges and recesses of the first grating, in a first area of the hard surface of the embossing body, corresponding to the enclosure of the determined perimeter;

roughening portions of the hard surface of the embossing body, the roughed portions located between adjacent lines of pyramids inside the enclosure of the determined perimeter, adapted to positions of the third plurality of pyramids; and providing a fourth plurality of pyramids with rhomboid shaped bases according to fourth intermitted lines corresponding to the intended ridges to emboss of the second grating, in a second area of the hard surface of the counter embossing body, corresponding to the enclosure of the determined perimeter.

3. The method according to claim 1, wherein the embossing body and the counter embossing body are configured to cooperate amongst each other in a planar embossing process, wherein the embossing body comprises any one of the list comprising a two dimensional surface, a surface exhibiting 3D structures, and an undulated surface.

4. The method according to claim 1, wherein the embossing body and the counter embossing body are configured to cooperate amongst each other as rollers in a roller embossing process.

5. The method of claim 4, wherein the rollers are synchronized among each other by toothed wheels.

6. The method according to claim 1, wherein the planar material is a metal foil.

7. The method according to claim 1, wherein the planar material is metal coated on the first side.

8. The method according to claim 1, wherein the hard surface comprises a hard coating.

9. The method according to claim 8, wherein the hard coating comprises TaC.

10. The method according to claim 1, wherein the step of roughening comprises treating the hard surface with a focused pico- or femto-second laser to produce elevated microstructures.

11. A device for embossing a first grating in a planar material comprising an embossing body and a counter embossing body having each a hard surface, the first grating to be embossed comprising alternating substantially parallel and straight ridges and recesses, the top surfaces of the ridges are intended to weaken a direct angular reflection of light by diffuse omnidirectional reflection, thereby producing a visible contrast between the ridges and the recesses, the embossing body including, a first plurality of pyramids with respective rhomboid-shaped bases on the hard surface of the embossing body, the first plurality of pyramids arranged in a first grid on the hard surface, and the summits of which face away from the hard surface of the embossing body, the first plurality of pyramids being intended to emboss the recesses of the first grating by exerting pressure on a first side of the planar material, the first plurality of pyramids forming first intermitted lines of the first grid corresponding to the intended recesses, and the pyramids in each subset corresponding to one of the first intermitted lines, being separated from each other between their bases by a determined distance that creates a gap in the line in such a manner that each gap from a line of pyramids may be connected to a corresponding gap from an adjacent line of pyramids by an imaginary line perpendicular to both of the adjacent lines; and roughed portions of the hard surface of the embossing body, the roughed portions arranged in a second grid, the first grid and the second grid interspersed with each other such that the bases of the first plurality of pyramids and the roughed portions form a checkerboard pattern on the hard surface of the embossing body, and the counter embossing body including, a second plurality of pyramids with respective rhomboid-shaped bases which are on the hard surface of the counter embossing body, the second plurality of pyramids arranged in a third grid on the hard surface, and the summits of which face away from the hard surface of the counter embossing body, the second plurality of pyramids being intended to emboss the ridges of the first grating by exerting pressure on a second side of the planar material opposite to the second side, the second plurality of pyramids forming second intermitted lines of the third grid corresponding to the intended ridges, and the pyramids in each subset corresponding to one of the second intermitted lines, being separated from each other between their bases by the determined distance, and the pyramids being positioned on their respective second intermitted lines in such a manner that during embossing their summits press the planar material against corresponding roughed portions arranged in the second grid on the hard surface of the embossing body, thereby satinizing the top surfaces of the ridges on the first side.

12. The device of claim 11, further adapted for embossing a second grating enclosed in a determined perimeter delimiting an image, alternating and substantially parallel ridges and recesses of the second grating are in a first determined angle to the ridges and recesses of the first grating, the embossing body further including, a third plurality of pyramids with rhomboid shaped bases according to third intermitted lines corresponding to the recesses to emboss of the second grating, in a first area of the hard surface of the embossing body, corresponding to the enclosure of the determined perimeter;

roughed portions of the hard surface of the embossing body, that are located between adjacent lines of pyramids inside the enclosure of the determined perimeter, adapted to positions of the third plurality of pyramids, and the counter embossing body further including, a fourth plurality of pyramids with rhomboid shaped bases according to fourth intermitted lines corresponding to the intended ridges to emboss of the second grating, in a second area of the hard surface of the counter embossing body, corresponding to the enclosure of the determined perimeter.

13. The device according to claim 11, wherein the embossing body and the counter embossing body are configured to cooperate amongst each other in a planar embossing process, whereby the embossing body comprises any one of the list comprising a two dimensional surface, a surface exhibiting 3D structures, and an undulated surface.

14. The device according to claim 11, wherein the embossing body and the counter embossing body are configured to cooperate amongst each other as rollers in a roller embossing process.

15. The device of claim 14, wherein the rollers are synchronized among each other by toothed wheels.

16. The device according to claim 11, wherein the planar material is a metal foil.

17. The device according to claim 11, wherein the planar material is metal coated on the first side.

18. The device according to claim 11, wherein the hard surface comprises a hard coating.

19. The device according to claim 18, wherein the hard coating comprises TaC.

20. The device according to claim 11, wherein the roughed surface results from a treatment of the hard surface with a focused pico- or femto-second laser in order to produce elevated microstructures.

21. A method for embossing a first grating in a planar material, by an embossing body and a counter embossing body having each a hard surface, the first grating to be embossed comprising alternating substantially parallel and straight ridges and recesses, whereby the top surfaces of the ridges are intended to weaken a direct angular reflection of light by diffuse omnidirectional reflection, thereby producing a visible contrast between the ridges and the recesses, the embossing body including, a first plurality of pyramids with respective rhomboid-shaped bases which are on the hard surface of the embossing body, the first plurality of pyramids arranged in a first grid on the hard surface, and the summits of which face away from the hard cylindrical surface of the embossing body, the first plurality of pyramids being intended to emboss the recesses of the first grating by exerting pressure on a first side of the planar material, the first plurality of pyramids forming first intermitted lines corresponding to the intended recesses, and the pyramids in each subset corresponding to one of the first intermitted lines of the first grid, being separated from each other between their bases by a determined distance that creates a gap in the line in such a manner that each gap from a line of pyramids may be connected to a corresponding gap from an adjacent line of pyramids by an imaginary line perpendicular to both of the adjacent lines; and roughed portions of the hard surface of the embossing body arranged in a second grid, the first grid and the second grid interspersed with each other such that the bases of the first plurality of pyramids and the roughed portions form a checkerboard pattern on the hard surface of the embossing body, the counter embossing body including, a second plurality of pyramids with respective rhomboid-shaped bases which are on the hard surface of the counter embossing body, the second plurality of pyramids arranged in a third grid on the hard surface, the summits of which face away from the hard surface of the counter embossing body, the second plurality of pyramids being intended to emboss the ridges of the first grating by exerting pressure on a second side of the planar material opposite to the first side, the second plurality of pyramids forming second intermitted lines of the third grid corresponding to the intended ridges, and the pyramids in each subset corresponding to one of the second intermitted lines, being separated from each other between their bases by the determined distance, and the pyramids being positioned on their respective second intermitted lines in such a manner that during embossing their summits press the planar material against corresponding roughed portions arranged in the second grid on the hard surface of the embossing roller, thereby satinizing the top surfaces of the ridges, the method comprising the step of:

embossing the planar material with the embossing body and the counter embossing body.

22. The method of claim 21, the embossing body further including, a third plurality of pyramids with rhomboid shaped bases according to third intermitted lines corresponding to recesses to emboss of the second grating, in a first area of the hard surface of the embossing body, corresponding to the enclosure of the determined perimeter; and roughed portions of the hard surface of the embossing body, that are located between adjacent lines of pyramids inside the enclosure of the determined perimeter, adapted to positions of the third plurality of pyramids, the counter embossing body further including, a fourth plurality of pyramids with rhomboid shaped bases according to fourth intermitted lines corresponding to the intended ridges to emboss of the second grating, in a second area of the hard surface of the counter embossing body, corresponding to the enclosure of the determined perimeter, the method further comprising the step of:

embossing the second grating enclosed in a determined perimeter delimiting an image, whereby alternating and substantially parallel ridges and recesses of the second grating are in a first determined angle to the ridges and recesses of the first grating.

23. The method according to claim 1, wherein the first and second plurality of pyramids are obtuse.

24. The device according to claim 11, wherein the first and second plurality of pyramids are obtuse.

25. The method according to claim 21, wherein the first and second plurality of pyramids are obtuse.

* * * * *